US009953566B2

(12) United States Patent
Huangfu et al.

(10) Patent No.: US 9,953,566 B2
(45) Date of Patent: Apr. 24, 2018

(54) PIXEL CIRCUIT AND DRIVING METHOD THEREOF, DISPLAY DEVICE

(71) Applicant: BOE TECHNOLOGY GROUP CO., LTD., Beijing (CN)

(72) Inventors: Lujiang Huangfu, Beijing (CN); Liang Sun, Beijing (CN); Zhanjie Ma, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 338 days.

(21) Appl. No.: 14/762,014

(22) PCT Filed: Aug. 25, 2014

(86) PCT No.: PCT/CN2014/085118
§ 371 (c)(1),
(2) Date: Jul. 20, 2015

(87) PCT Pub. No.: WO2015/192470
PCT Pub. Date: Dec. 23, 2015

(65) Prior Publication Data

US 2016/0253961 A1 Sep. 1, 2016

(30) Foreign Application Priority Data

Jun. 17, 2014 (CN) ..... 2014 1 0270215

(51) Int. Cl.
*G09G 5/10* (2006.01)
*G09G 3/3225* (2016.01)
(Continued)

(52) U.S. Cl.
CPC ..... *G09G 3/3225* (2013.01); *G09G 3/3233* (2013.01); *G09G 3/3659* (2013.01);
(Continued)

(58) Field of Classification Search
CPC .. G09G 3/3225; G09G 3/3659; G09G 3/3233; G09G 2320/0223;
(Continued)

(56) References Cited

U.S. PATENT DOCUMENTS

2004/0125101 A1* 7/2004 Choi ..... G09G 3/3233 345/212
2007/0063932 A1 3/2007 Nathan et al.
(Continued)

FOREIGN PATENT DOCUMENTS

CN 1614672 5/2005
CN 1617204 5/2005
(Continued)

OTHER PUBLICATIONS

Office action from Chinese Application No. 201410270215.5 dated Oct. 27, 2015.
(Continued)

*Primary Examiner* — Michael Pervan
*Assistant Examiner* — Andrew Lee
(74) *Attorney, Agent, or Firm* — Calfee, Halter & Griswold LLP

(57) ABSTRACT

The present invention discloses a pixel circuit and a driving method thereof, and a display device. The pixel circuit comprises a reference voltage set up sub-circuit, a charging sub-circuit and a driving sub-circuit. The reference voltage set up sub-circuit and the charging sub-circuit are connected with the driving sub-circuit respectively, and the reference voltage set up sub-circuit being used for, within a first period of time, providing for the driving sub-circuit, the charging sub-circuit being used for, within a second period of time, providing for the driving sub-circuit a data signal voltage. The driving sub-circuit comprises a driving transistor for driving the light emitting device to emit light, and a first
(Continued)

capacitor for maintaining the reference voltage and the data signal voltage. Within a third period of time, the first capacitor discharges so that the driving transistor is turned on to drive the light emitting device to emit light.

15 Claims, 4 Drawing Sheets

(51) Int. Cl.
*G09G 3/3233* (2016.01)
*G09G 3/36* (2006.01)

(52) U.S. Cl.
CPC ..... *G09G 2300/0819* (2013.01); *G09G 2300/0852* (2013.01); *G09G 2300/0861* (2013.01); *G09G 2320/0223* (2013.01); *G09G 2320/0626* (2013.01)

(58) Field of Classification Search
CPC ... G09G 2320/0626; G09G 2300/0861; G09G 2300/0852; G09G 2300/0819
See application file for complete search history.

(56) References Cited

U.S. PATENT DOCUMENTS

| | | | | |
|---|---|---|---|---|
| 2009/0309816 | A1 | 12/2009 | Choi | |
| 2012/0050346 | A1* | 3/2012 | Sung | G09G 3/3233 345/690 |
| 2013/0088482 | A1* | 4/2013 | Nathan | G09G 3/3233 345/212 |
| 2013/0127932 | A1 | 5/2013 | Han | |
| 2014/0028859 | A1* | 1/2014 | Kim | G09G 3/30 348/189 |

FOREIGN PATENT DOCUMENTS

| | | |
|---|---|---|
| CN | 1811882 | 8/2006 |
| CN | 101847363 | 9/2010 |
| CN | 101866619 | 10/2010 |
| CN | 102339586 | 2/2012 |
| CN | 102930824 | 2/2013 |
| CN | 103226931 | 7/2013 |
| CN | 103325335 | 9/2013 |
| CN | 103383835 | 11/2013 |
| CN | 103854609 | 6/2014 |
| KR | 1020050110458 | 11/2005 |
| KR | 1020080001482 | 1/2008 |
| KR | 20140064508 | 5/2014 |

OTHER PUBLICATIONS

International Search Report and Written Opinion from PCT/CN2014/086118 dated Apr. 1, 2015 along with English translation.

* cited by examiner

PIXEL CIRCUIT AND DRIVING METHOD THEREOF, DISPLAY DEVICE

RELATED APPLICATIONS

The present application is the U.S. national phase entry of PCT/CN2014/085118, with an international filing date of Aug. 25, 2014, which claims the benefit of Chinese Patent Application No. 201410270215.5, filed on Jun. 17, 2014, the entire disclosures of which are incorporated herein by reference.

FIELD OF THE INVENTION

The present invention relates to the field of organic light emitting technology, particularly to a pixel circuit of an active-matrix organic light emitting diode (AMOLED) display as well as a driving method thereof, and a display device.

BACKGROUND OF THE INVENTION

The organic light emitting diode (OLED) display has attracted attention due to its advantages of low power consumption, high luminance, low cost, wide visual angle and high response speed etc., and has been widely used in the field of organic light emitting technology.

In an OLED display, the current for driving the OLED is determined by the following formula (1-1):

$$I_{oled}=K(V_{gs}-V_{th})^2 \quad (1\text{-}1)$$

where $I_{oled}$ is current that flows through the OLED, K is a coefficient factor, $V_{gs}$ is a voltage between the gate and the source of the driving transistor for driving the OLED, and $V_{th}$ is a threshold voltage of the driving transistor.

$V_{gs}$ is generally determined by the data signal voltage $V_{data}$ (i.e., pixel gray-scale voltage) stored on the hold capacitor $C_{st}$ and the reference voltage of the hold capacitor $C_{st}$. In the prior art, the reference voltage is generally provided by the DC power supply that supplies driving current to the OLED, i.e., being provided by the DC power supply that supplies $V_{dd}$ or $V_{ss}$, the reference voltage is equal to the reference voltage $V_{dd}$ or $V_{ss}$ provided by the DC power supply. Therefore, the current for driving the OLED in the prior art is determined by the following formula (1-2):

$$I_{oled}=K(V_{data}-V_{dd}-V_{th})^2 \quad (1\text{-}2)$$

Since $V_{dd}$ is a voltage signal provided by the DC power supply, all the associated pixels drive the OLED in the whole frame period. The pixel driving current associated with a DC power supply line is relatively large after being converged; and the IR drop on the line is also relatively large. When the voltage $V_{dd}$ provided by the DC power supply arrives at the reference voltage end on the hold capacitor $C_{st}$, the IR drop is $\Delta R\times I$, wherein R represents resistance of equivalent layout of the pixel to the power supply, I represents the equivalent current on layout of the power supply, and $\Delta$ represents difference between pixels at different positions. The actual reference voltage for charging the hold capacitor $C_{st}$ is $V_{dd}'(V_{dd}'=V_{dd}-\Delta R\times I)$.

Since the value of I in $\Delta R\times I$ is relatively large, R also cannot be reduced infinitely due to process limitation. Therefore, the decreasing amplitude of $V_{dd}$ relative to $V_{dd}$ is relatively large. That is, the voltage signal held by the hold capacitor $C_{st}$ of the pixel would also be influenced by the IR drop, thereby influencing normal display driving.

At present, the difference in the reference voltage caused by different IR drops of pixels at different positions can be compensated by a pixel compensation circuit, however, the circuit is generally complex. A separate line may also be used for providing the reference voltage to the hold capacitor $C_{st}$, however, the layout is relatively complex.

SUMMARY OF THE INVENTION

An aspect of the present invention provides a pixel circuit for avoiding pixel driving signal voltage deviation caused by layout IR drop of pixel array circuit, so as to improve uniformity of image luminance in the display area of the display device.

In order to achieve said object, the pixel circuit for driving a light emitting device to emit light provided by an embodiment according to the present invention comprises: a reference voltage set up sub-circuit, a charging sub-circuit and a driving sub-circuit;

the reference voltage set up sub-circuit and the charging sub-circuit being connected with the driving sub-circuit respectively, the reference voltage set up sub-circuit being used for, within a first period of time, setting up a reference voltage required by a drive data signal of the driving sub-circuit for driving the light emitting device to emit light, the charging sub-circuit being used for, within a second period of time, providing for the driving sub-circuit a data signal voltage required by the drive data signal for controlling the driving;

the driving sub-circuit comprising: a driving transistor for driving the light emitting device to emit light, and a first capacitor for maintaining the reference voltage and the data signal voltage; within a third period of time, the first capacitor discharging so that the driving transistor is turned on to drive the light emitting device to emit light.

In an embodiment, the reference voltage set up sub-circuit comprises a first data signal source for providing the reference voltage, the first data signal source is a pulse signal source.

In an embodiment, the charging sub-circuit comprises a second data signal source for providing the data signal voltage, the first data signal source and the second data signal source are the same data signal source, the first data signal source outputs the reference voltage within the first period of time, and outputs the data signal voltage within the second period of time after the first period of time.

In an embodiment, the first data signal source transmits the reference voltage and the data signal voltage through a data line for transmitting the data signal voltage.

In an embodiment, a gate of the driving transistor is connected with a second end of the first capacitor, a source and a drain of the driving transistor are connected with a first reference signal source and an input end of the light emitting device respectively, an output end of the light emitting device is connected with a second reference signal source.

In an embodiment, the reference voltage set up sub-circuit further comprises: a first timing control signal source, a second timing control signal source, a second capacitor, a first switch transistor and a second switch transistor;

two ends of the second capacitor is connected with the first reference signal source and a drain of the first switch transistor respectively; the first timing control signal source is connected with a gate of the first switch transistor, the first data signal source is connected with a source of the first switch transistor; the second timing control signal source is connected with a gate of the second switch transistor, a source of the second switch transistor is connected with the drain of the first switch transistor, a drain of the second switch transistor is connected with a first end of the first capacitor.

In an embodiment, the charging sub-circuit further comprises: a third switch transistor;

a gate of the third switch transistor is connected with the second timing control signal source, a source of the third switch transistor is connected with the first data signal source, a drain of the third switch transistor is connected with a second end of the first capacitor.

In an embodiment, the pixel circuit further comprises: a luminescence control sub-circuit, the luminescence control sub-circuit comprising:

a luminescence control signal source, a fourth switch transistor and a fifth switch transistor, gates of the fourth switch transistor and the fifth switch transistor being connected with the luminescence control signal source respectively;

a source and a drain of the fourth switch transistor being connected with the first end of the first capacitor and the first reference signal source respectively;

a source and a drain of the fifth switch transistor being connected with the drain of the driving transistor and the input end of the light emitting device.

In an embodiment, the reference voltage set up sub-circuit further comprises: a third timing control signal source, a fourth timing control signal source, a third capacitor, a sixth switch transistor and a seventh switch transistor;

a second end of the third capacitor is connected with the second reference signal source, a first end of the third capacitor is connected with a drain of the sixth switch transistor; a gate of the sixth switch transistor is connected with the third timing control signal source, a source of the sixth switch transistor is connected with the first data signal source;

a gate of the seventh switch transistor is connected with the fourth timing control signal source, a source of the seventh switch transistor is connected with a first end of the third capacitor, a drain of the seventh switch transistor is connected with the first end of the first capacitor.

In an embodiment, the charging sub-circuit further comprises:

a fifth timing control signal source, an eighth switch transistor, a ninth switch transistor;

a gate of the eighth switch transistor is connected with the fifth timing control signal source, a source of the eighth switch transistor is connected with the first data signal source, a drain of the eighth switch transistor is connected with the first end of the first capacitor;

a gate of the ninth switch transistor is connected with the fifth timing control signal source, a source of the ninth switch transistor is connected with the first reference signal source, a drain of the ninth switch transistor is connected with the second end of the first capacitor.

In an embodiment, the first switch transistor, the second switch transistor, the third switch transistor, the fourth switch transistor, the fifth switch transistor, the sixth switch transistor, the seventh switch transistor, the eighth switch transistor and the ninth switch transistor are n-type transistor or p-type transistor.

Another aspect of the present invention provides a driving method of a pixel circuit for driving a light emitting device to emit light, comprising the steps of:

controlling the reference voltage set up sub-circuit to provide a reference voltage to the driving sub-circuit, and controlling the charging sub-circuit to provide a data signal voltage to the driving sub-circuit;

the driving sub-circuit, under the effect of the reference voltage and the data signal voltage, driving the light emitting device to emit light.

In an embodiment, through a data line connected with the reference voltage set up sub-circuit and the charging sub-circuit, the reference voltage is provided to the reference voltage set up sub-circuit within the first period of time, the data signal voltage is provided to the charging sub-circuit within the second period of time, the reference voltage is an AC signal voltage.

A further aspect of the present invention provides a display device comprising a pixel circuit in any of the above.

The pixel circuit provided by an embodiment according to the present invention comprises: a reference voltage set up sub-circuit, a charging sub-circuit and a driving sub-circuit; the reference voltage set up sub-circuit and the charging sub-circuit being connected with the driving sub-circuit respectively, the reference voltage set up sub-circuit being used for, within a first period of time, providing for the driving sub-circuit a reference voltage, the charging sub-circuit being used for, within a second period of time, providing for the driving sub-circuit a data signal voltage; the driving sub-circuit comprising a driving transistor for driving the light emitting device to emit light, and a first capacitor for maintaining the reference voltage and the data signal voltage; within a third period of time, the first capacitor discharging so that the driving transistor is turned on to drive the light emitting device to emit light. The reference voltage set up sub-circuit provides a reference voltage for the OLED to keep the data signal voltage, which can ensure that the driving voltage for driving the OLED to emit light during the luminescence phase is unrelated to the layout IR drop of the pixel circuit, thereby improving uniformity of the image luminance in the display area of the display device.

DETAILED DESCRIPTION OF THE INVENTION

Figure 1:
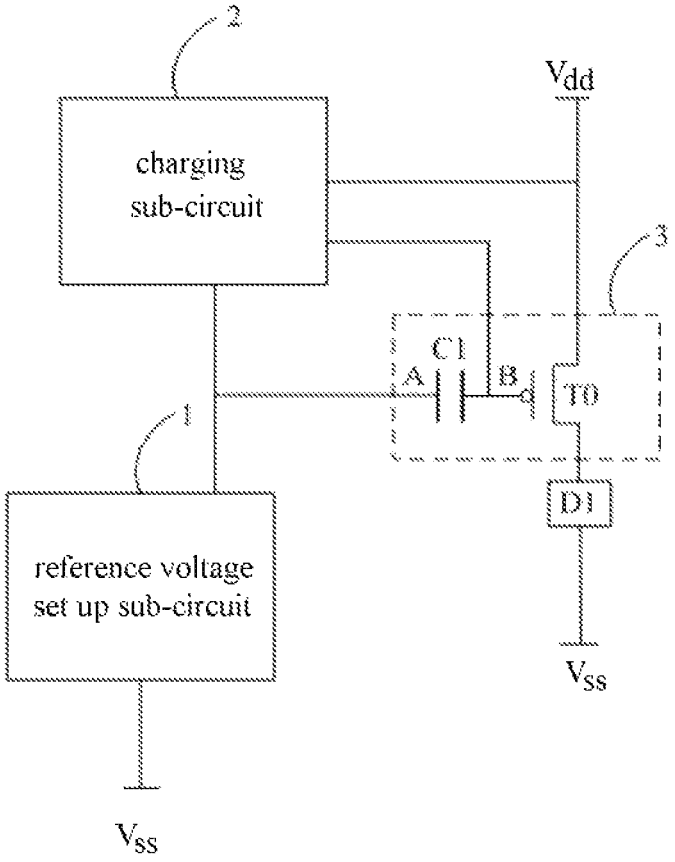
FIG. 1 is a pixel circuit for driving a light emitting device to emit light provided by an embodiment according to the present invention.

An embodiment according to the present invention provides a pixel circuit for avoiding pixel driving signal voltage deviation caused by layout IR drop of pixel array circuit, so as to improve uniformity of the image luminance in the display area of the display device. Other embodiments according to the present invention further provide a method for driving the above pixel circuit, and a display device comprising the above pixel circuit.

It should be noted that the reference voltage required by the driving data signal of the driving sub-circuit in the prior art for driving the light emitting device to emit light is the voltage signal $V_{dd}$ provided by the DC power supply, so the IR drop on the line is relatively large. The present invention provides the reference voltage through the data signal source that provides a data signal (i.e., gray-scale signal, the corresponding voltage is the data signal voltage) for the pixel circuit in the prior art, so the data signal source successively outputs pulse signals corresponding to the reference voltage and the data signal voltage respectively under the control of the time sequence, so as to charge the corresponding hold capacitor $C_{st}$.

The reference voltage is a reference voltage that ensures accurate charging of the hold capacitor $C_{st}$.

The pixel circuit is a pixel circuit corresponding to a light emitting device, a plurality of light emitting devices are connected with a plurality of pixel circuits in one-to-one correspondence; the data signal sources in the pixel circuits to which a plurality of different light emitting devices correspond can be shared. For example, the data signal sources in respective pixel circuits to which a column of pixels correspond are shared, the timing control signal sources in respective pixel circuits to which a row of pixels correspond can be shared. "Share" here can be understood as providing output signals for different pixel circuits.

Specifically, with respect to a pixel array with M×N pixels, M is the total row number of the pixels, N is the total column number of the pixels, there are N data lines connected with N columns of pixels in one-to-one correspondence, i.e., each data line is connected with the respective pixel circuits in one column of pixels, providing data signal and reference voltage signal for the source of the thin film transistor of the corresponding light emitting device in the pixel circuit, wherein M and N are positive integers.

There are three phases in the scanning period T of each row of pixels, respectively including: a reference voltage set up phase (a first phase t1 of the row scanning period), a charging phase (a second phase t2 of the row scanning period) and a driving phase (a third phase t3 of the row scanning period), wherein T=t1+t2+t3.

Next, the pixel circuit in any pixel of the nth row of pixels in the pixel array provided by the embodiment of the present invention will be explained specifically in combination with the drawings, wherein n=1, 2, 3, . . . , M.

Referring to FIG. 1, an embodiment of the pixel circuit for driving the light emitting device D1 is provided and comprises: a reference voltage set sub-circuit 1, a charging sub-circuit 2 and a driving sub-circuit 3. The reference voltage set up sub-circuit 1 and the charging sub-circuit 2 are connected with the driving sub-circuit 3 respectively.

Within one row scanning period of active matrix display, the reference voltage set up sub-circuit 1 is used for providing a reference voltage $V_{ref0}$ for the driving sub-circuit 3 in the reference voltage set up phase (the first phase of the row scanning period). This sets up the reference voltage $V_{ref0}$ required by the driving data signal (the corresponding voltage is $V_{driving}$) of the driving sub-circuit 3 for driving the light emitting device D1 to emit light.

The charging sub-circuit 2 provides a data signal voltage $V_{data}$ (this voltage is a gray-scale voltage for image display) for the driving sub-circuit 3 in the charging phase (the second phase of the row scanning period). The charging sub-circuit 2 provides, for the driving sub-circuit 3, a data signal voltage $V_{data}$ required by the drive data signal $V_{driving}$ for controlling the driving within the second period of time.

The driving sub-circuit 3 comprises: a driving transistor T0 for driving the light emitting device D1 to emit light, and a first capacitor C1 for maintaining the reference voltage $V_{ref0}$ and the data signal voltage $V_{data}$ provided by the reference voltage set up sub-circuit 1 and the charging sub-circuit 2, respectively. In the driving phase (the third phase of the row scanning period), the first capacitor C1 discharges so that the driving transistor T0 is turned on to drive the light emitting device D1 to emit light.

It shall be noted that the data signal charges the first capacitor C1. The voltage maintained by one end of the first capacitor C1 is the data signal voltage to which the data signal corresponds, and the voltage maintained by the other end of the first capacitor C1 is the reference voltage. The reference voltage is used for providing a reference voltage when charging the data signal, so as to ensure accuracy of the voltage value after the data signal is charged.

The reference voltage sub-circuit is independent of the DC power supply that provides a driving current for the light emitting device (i.e., a reference voltage $V_{dd}$ or $V_{ss}$ provided for the light emitting device of the pixel circuit to be driven). A reference voltage is provided for the first capacitor C1 through the reference voltage set up sub-circuit. The two are mutually independent.

The light emitting device can be an organic light emitting diode (OLED) or other organic light emitting devices (EL) etc. Generally, the data signal voltage Vdata provides a pulse voltage for the pulse signal source, the charging current on the line is very small. Hence, the IR drop on the line is also very small, so it can be ignored relative to the IR drop generated by the DC signal provided by the DC power supply on the line.

FIG. 1 is a pixel circuit provided by an embodiment according to the present invention. It will be explained by taking the example that the light emitting device is an OLED display, the current for driving the OLED is determined by the following formula (2-1):

$$I_{oled}=K(V_{gs}-V_{th})^2 \tag{2-1}$$

The $I_{oled}$ in formula (2-1) is current that flows through the OLED, K is a constant coefficient, $V_{gs}$ is a voltage between the gate (g) and the source (s) of the driving transistor T0 for driving the OLED to emit light, and $V_{th}$ is a threshold voltage of the driving transistor T0.

In the pixel circuit as shown in FIG. 1, the value of $V_{gs}$ is equal to the voltage value maintained across the first capacitor C1, i.e., $V_{gs}=V_{data}-V_{ref0}$. Therefore, $I_{oled}=K(V_{data}-V_{ref0}-V_{th})^2$. Thus it can be seen that $I_{oled}$ is unrelated to the first reference voltage $V_{ref1}$ and the second reference voltage $V_{ref2}$ for providing working currents for the OLED. $V_{ref0}$ is a reference voltage provided by the reference voltage set up sub-circuit. The first reference voltage $V_{ref1}$ is DC power supply $V_{dd}$, the second reference voltage $V_{ref2}$ is DC power supply $V_{ss}$.

In the process of specific implementation, the signal source in the reference voltage set up sub-circuit for providing the reference voltage $V_{ref0}$ may be a DC signal source or a pulse signal source. The circuit structure shown in FIG. 1 can avoid IR drop on the line brought by providing the reference voltage for the first capacitor C1 by the reference signal source (i.e., the DC power supply) in the pixel circuit for providing the first reference voltage and the second reference voltage, e.g., the first DC power supply for providing Vdd or the second DC power supply for providing Vss. According to an embodiment, the reference voltage is provided by the pulse signal source, and the current of the pulse signal for charging the first capacitor is very small, which can almost be ignored. Therefore, the value of the charging voltage $V_{ref0}$ for charging the first capacitor is hardly reduced, which avoids deviation of the driving data signal voltage $V_{driving}$ for driving the light emitting device D1 to emit light caused by the layout IR drop of the reference voltage. Thereby, uniformity of the image luminance in the display area of the display device is improved.

Generally, a reference voltage can be provided for one end of the first capacitor through the first reference signal source (the first DC power supply) that can provide $V_{dd}$ and the second reference signal source (the second DC power supply) that can provide $V_{ss}$, the first reference signal source and the second reference signal source are DC power supplies, and the first reference signal source and the second reference signal source provide $V_{dd}$ and $V_{ss}$ for M rows and N columns of pixels simultaneously. The values of $V_{dd}$ and $V_{ss}$ are very large, for example, the value of $V_{dd}$ is approximately equal to M times or N times of $V_d$, the $V_d$ is a reference voltage required by a pixel in normal work. Therefore, the IR drop of $V_{dd}$ and $V_{ss}$ on the line is very large, such that the actual voltage value is less than the voltage value $V_{dd}$ and $V_{ss}$ provided by the first reference signal source and the second reference signal source respectively. When the $V_{dd}$ and the $V_{ss}$ are applied on one end of the first capacitor, the layout IR drop of the reference voltage is relatively large, and the uniformity of the image luminance in the display area of the display device is relatively low.

According to an embodiment, the signal source in the reference voltage set up sub-circuit for providing $V_{ref0}$ is a pulse signal source. In other words, the reference voltage set up sub-circuit comprises: a first data signal source for providing the reference voltage, wherein the first data signal source is a pulse signal source. It has been described above, the current of the pulse signal for charging the first capacitor is very small, the current in the line is also very small, which can almost be ignored. Hence, the value of the charging voltage $V_{ref0}$ for charging the first capacitor is hardly reduced, which avoids deviation of the driving data signal voltage $V_{driving}$ for driving the light emitting device D1 to emit light caused by the layout IR drop of the reference voltage, thereby improving uniformity of the image luminance in the display area of the display device.

The charging sub-circuit comprises a second data signal source for providing the data signal voltage $V_{data}$. The first data signal source and the second data signal source may be a same data signal source in hardware, and may also be mutually independent signal sources. When the first data signal source and the second data signal source are the same data signal source in hardware, it has two functions of the first data signal source and the second data signal source simultaneously, which are respectively: the function of providing a reference voltage for one end of the first capacitor, and the function of providing a data signal voltage (i.e., a gray-scale voltage) for the other end of the first capacitor. The two functions are performed successively and do not influence each other.

Specifically, the first data signal source and the second data signal source are the same data signal source in hardware. The data signal source (the data signal source is the first data signal source or the second data signal source with the two functions simultaneously) provides the reference voltage for the driving sub-circuit in the first period of time, and provides the data signal voltage for the driving sub-circuit in the second period of time. Hence, the circuit structure can be simplified when the first data signal source and the second data signal source are the same data signal source in hardware.

According to an embodiment, when the first data signal source and the second data signal source are different data signal sources in hardware, the first data signal source and the second data signal source are connected with the driving sub-circuit through a data line for transmitting the data signal voltage $V_{data}$. When the first data signal source and the second data signal source are the same data signal source, the first data signal source is connected with the driving sub-circuit through a data line for transmitting the data signal voltage $V_{data}$.

The present invention can provide the reference voltage and the data signal voltage through a data line in different periods of time respectively. It does not require wirings for providing the reference voltage independent of the data line, the circuit structure is simplified, and the pixel driving signal voltage deviation caused by layout IR drop of pixel array circuit is also avoided. The important thing is that the difficulty and cost of arranging wirings in the finite pixel area is very large.

The data signal source can be realized by a source driving circuit, the performing time of the two functions of the data signal source can be realized under the control of the time sequence.

Referring again to FIG. 1, specifically, the gate of the driving transistor T0 is connected with the second end (end B) of the first capacitor C1. The source and the drain of the driving transistor T0 are connected with the first reference signal source, corresponding to the power supply voltage (which is generally a DC voltage) for providing $V_{ref1}$, and the input end of the light emitting device D1 respectively. The output end of the light emitting device D1 is connected with the second reference signal source, corresponding to the power supply voltage (which is generally a DC voltage) for providing $V_{ref2}$.

Next, the specific implementing mode of the pixel circuit as shown in FIG. 1 will be explained specifically.

Figure 2:
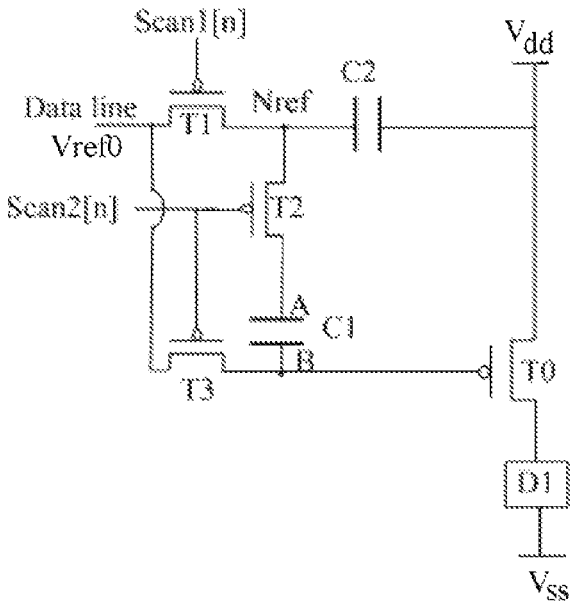
FIG. 2 is a specific structural schematic view of the pixel circuit as shown in FIG. 1.

Referring to FIG. 2, which is a specific structural schematic view of the pixel circuit as shown in FIG. 1. In the pixel circuit as shown in FIG. 1, the reference voltage set up sub-circuit 1, in addition the first data signal source for providing the reference voltage $V_{ref0}$, further comprises: a first timing control signal source, a second timing control signal source, a second capacitor C2, a first switch transistor T1, and a second switch transistor T2.

The first timing control signal source and the second timing control signal source transmit the output signal to the corresponding circuit through a signal line for transmitting the signal respectively. Since the first timing control signal source and the second timing control signal source are connected with the gates of different thin film transistors in the pixel circuit respectively, the signal line for transmitting the signal can also be called a scanning signal line. The pixel circuit as shown in FIG. 2 comprises two timing control signal sources and two scanning signal lines, which are respectively a first scanning signal line and a second scanning signal line.

Within one row scanning period, the first timing control signal source and the second timing control signal source output different timing signals for controlling on and off of the corresponding thin film transistors in different phases of the whole row scanning period, respectively. The on or off state of the thin film transistor in different phases is determined by high or low level of the timing signal outputted by the corresponding timing control signal source.

With respect to a pixel in the nth row and mth column, the first data signal source transmits the data signal $V_{data}$ to the corresponding circuit through the data line as shown in FIG. 2. The data line is the mth data line in the whole pixel array; m and n are positive integers.

The first timing control signal source transmits the timing control signal to the corresponding circuit through a first scanning signal line Scan1[$n$] as shown in FIG. 2. The second timing control signal source transmits the timing control signal to the corresponding circuit through a second scanning signal line Scan2[$n$], as shown in FIG. 2; n is a positive integer greater than 0.

The two ends of the second capacitor C2 are connected with the first reference signal source and the drain of the first switch transistor T1 respectively. The end of the second capacitor C2 close to the first switch transistor T1 is set as a node Nref. The first timing control signal source is connected with the gate of the first switch transistor T1 through the first scanning signal line Scan1[$n$]. The first data signal source is connected with the source of the first switch transistor T1 through the data line. The second timing control signal source is connected with the gate of the second switch transistor T2 through the second scanning signal line Scan2[$n$]. The source of the second switch transistor T2 is connected with the drain of the first switch transistor T1. The drain of the second switch transistor T2 is connected with the first end (end A) of the first capacitor C1. The second end (end B) of the first capacitor C1 is connected with the gate of the driving transistor T0.

The charging sub-circuit 2, besides including the first data signal source for providing the data signal voltage $V_{data}$ (here the first data signal source is a data signal source shared by the charging sub-circuit 2 and the reference voltage set up sub-circuit 1), further comprises: a third switch transistor T3.

The gate of the third switch transistor T3 is connected with the second timing control signal source through the second scanning signal line Scan2[$n$]. The source of the third switch transistor T3 is connected with the first data signal source through the data line, the drain of the third switch transistor T3 is connected with the second end (end B) of the first capacitor C1.

Figure 3:
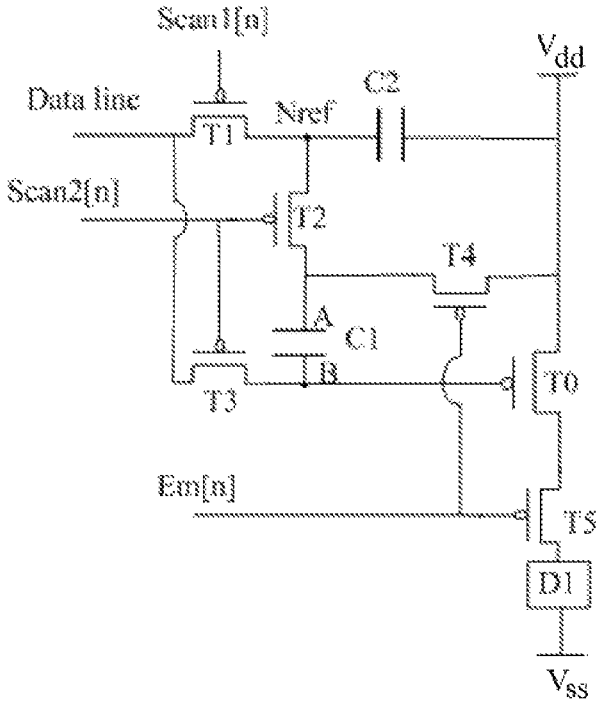
FIG. 3 is another specific structural schematic view of the pixel circuit as shown in FIG. 1.

Referring to FIG. 3, the pixel circuit further comprises a luminescence control sub-circuit. The luminescence control sub-circuit comprises: a luminescence control signal source, a fourth switch transistor T4, and a fifth switch transistor T5. The gates of the fourth switch transistor T4 and the fifth switch transistor T5 are connected with the luminescence control signal source through a third scanning signal line Em[n] in the pixel circuit respectively. "Em" is the abbreviation of "emission" and n in Em[n] represents the nth row of pixel to which the third scanning signal line Em[n] corresponds.

Similar to the functions of the above first scanning signal line and the second scanning signal line, the third scanning signal line is used for transmitting signals for the luminescence control signal source. The luminescence control signal source is connected with the gates of the fourth switch transistor T4 and the fifth switch transistor T5. Hence, the signal outputted by the luminescence control signal source is a control signal for controlling simultaneous on or off of the fourth switch transistor T4 and the fifth switch transistor T5.

A signal transmitting line connected with the gate of the switch transistor is generally called a scanning signal line. It can also be called a scanning control signal line or a control signal line. The scanning signal line is only used for transmitting a control signal output from a corresponding signal source for controlling on or off of the switch transistor.

The pixel circuit as shown in FIG. 3, within one row scanning period, uses three scanning signal lines to control on and off of different switch transistors in each pixel circuit of the pixel circuit in this row respectively. This allows the pixel circuits in different phases of one row scanning period to have different functions.

In the process of specific implementation, a row of pixels correspond to three scanning signal lines. M rows of pixels corresponds to 3M scanning signal lines. Respective pixel circuits in one row of pixels are controlled by the three scanning signal lines simultaneously, so as to drive the light emitting device (such as OLED) to which this row of pixels correspond to emit light.

The source and the drain of the fourth switch transistor T4 are connected with the first end (end A) of the first capacitor C1 and the first reference signal source, respectively.

The source and the drain of the fifth switch transistor T5 are connected with the drain of the driving transistor T0 and the input end of the light emitting device D1 respectively, the output end of the light emitting device D1 is connected with the second reference signal source $V_{ss}$.

The respective timing control signal sources here can also be understood as pulse signal sources. The timing control signal source outputs a high level or a low level timing signal to control on or off of the switch transistor connected with it. The timing control signal source can be may be a gate driving circuit, such as a chip circuit or a GOA circuit integrated on a substrate.

The driving transistor T0 may be a p-type transistor or a n-type transistor, the first switch transistor, the second switch transistor, the third switch transistor, the fourth switch transistor, the fifth switch transistor may be p-type transistors or n-type transistors.

The n-type transistor or the driving transistor is turned on under the effect of high level, and is turned off under the effect of low level. The p-type transistor or the driving transistor is turned on under the effect of low level, and is turned off under the effect of high level. The turn off can be understood as disconnection.

The present invention explains the pixel circuit provided by respective embodiments according to the present invention and the principle of being driven to emit light by taking the example that the driving transistor T0 is a p-type transistor. The first switch transistor, the second switch transistor, the third switch transistor, the fourth switch transistor, and the fifth switch transistor are p-type transistors. For a p-type driving transistor, $V_{dd}$ is a positive value higher than the ground point GND, $V_{data}$ is a positive value. $V_{ss}$ is a negative value lower than the ground point GND.

Figure 4:
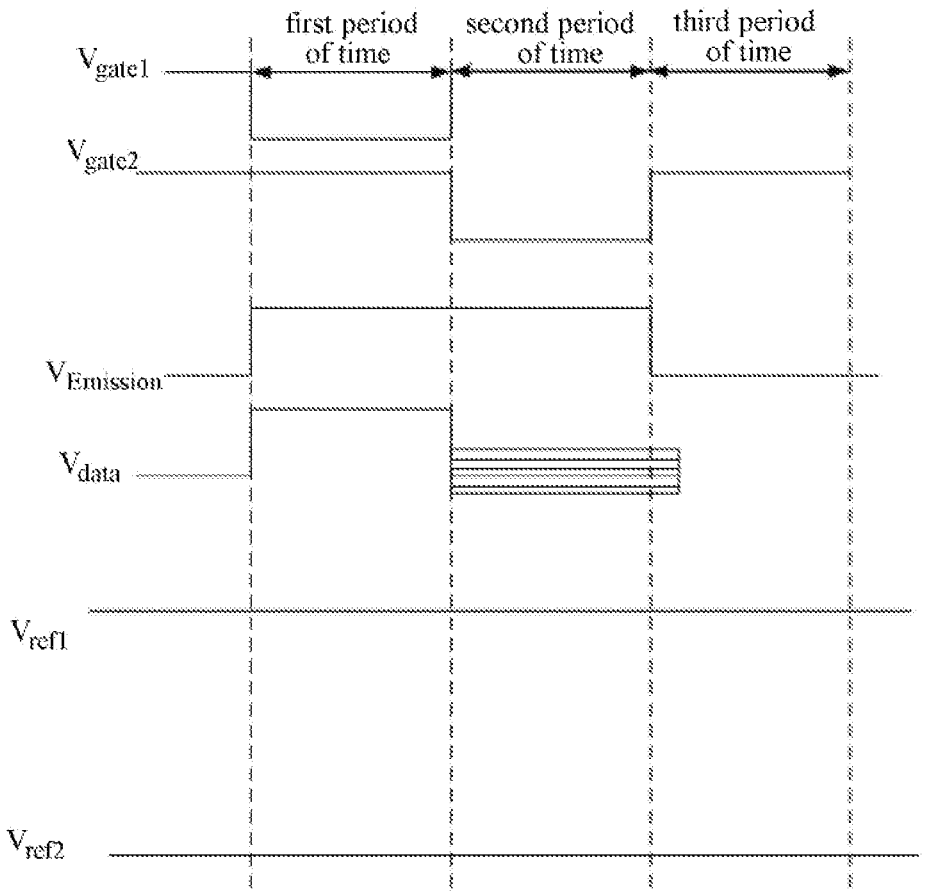
FIG. 4 is a timing diagram of working of the pixel circuit as shown in FIG. 3.

Next, the working principle of the pixel circuit provided by the above embodiment according to the present invention will be explained in combination with the timing diagrams as shown in FIG. 3 and FIG. 4.

The pixel circuit according to the embodiment of the present invention includes three working phases within one row scanning period of the active matrix display, which are successively: a reference voltage set up phase, a charging phase and a driving phase.

In the three phases of the reference voltage set up phase, the charging phase and the driving phase, the first reference signal source outputs $V_{ref1}=V_{dd}$. The second reference signal source outputs $V_{ref2}=V_{ss}$, $V_{dd}$ is greater than $V_{ss}$.

The First Phase (During Phase 1): The Reference Voltage Set Up Phase

The first timing control signal outputs a low level signal voltage $V_{gate1}$ to the first switch transistor T1 through the first scanning signal line Scan1[$n$]. The first switch transistor T1 is turned on under the effect of the low level signal voltage.

The second timing control signal source outputs a high level signal voltage $V_{gate2}$ to the second switch transistor T2 and the third switch transistor T3 through the second scanning signal line Scan2[$n$]. The second switch transistor T2 and the third switch transistor T3 are turned off under the effect of the high level signal voltage.

The luminescence control signal source outputs a high level signal voltage $V_{Emission}$ to the fourth switch transistor T4 and the fifth switch transistor T5 through the third scanning signal line Em[n]. The fourth switch transistor T4 and the fifth switch transistor T5 are turned off under the effect of the high level signal voltage.

The first data signal source outputs a high level signal voltage $V_{ref0}$ to the second capacitor C2 through the data line, the voltage $V_{ref0}$ is the reference voltage. The reference voltage $V_{ref0}$ is applied to one end of the second capacitor C2 close to the node Nref, so as to charge the node Nref of the second capacitor C2. After the charging is accomplished, the potential of the node Nref $V_{Nref}=V_{ref0}$.

The charge amount on the second capacitor C2 is as shown in formula (2-2):

$$Q_{ref0}=C_2\times(V_{ref0}-V_{ref1}) \quad (2\text{-}2)$$

wherein $C_2$ is the capacitance value of the second capacitor C2.

It shows that in phase 1, the control signal ($V_{gate1}$) outputted by the first timing control signal source enable the first switch transistor to be connected with the data line and one end of the second capacitor C2 close to the node Nref, one end of the node Nref can be called the reference potential end Nref. Here the second switch transistor T2 remains off, and is isolated from other circuits. The reference voltage signal $V_{ref0}$ on the data line charges the second capacitor C2 to set up the reference potential $V_{ref0}$.

The Second Phase (During Phase 2): The Charging Phase

The first timing control signal source outputs a high level signal voltage $V_{gate1}$ to the first switch transistor T1 through the first scanning signal line Scan1[$n$], the first switch transistor T1 is turned off under the effect of the high level signal voltage.

The second timing control signal source outputs a low level signal voltage $V_{gate2}$ to the second switch transistor T2 and the third switch transistor T3 through the second scanning signal line Scan2[$n$]. The second switch transistor T2 and the third switch transistor T3 are turned on under the effect of the low level signal voltage.

The luminescence control signal source outputs a high level signal voltage $V_{Emission}$ to the fourth switch transistor T4 and the fifth switch transistor T5 through the third scanning signal line Em[n]. The fourth switch transistor T4 and the fifth switch transistor T5 are turned off under the effect of the high level signal voltage.

The first data signal source outputs a data signal voltage $V_{data}$ to the first capacitor C1 through the data line, the voltage is a gray-scale voltage. The data signal voltage $V_{data}$, charges the second end of the first capacitor C1 through the third switch transistor T3, the potential of the second end (end B) of the first capacitor C1 is $V_{data}$. The potential of the first end (end A) of the first capacitor C1 is the potential of the node Nref, i.e. $V_{Nref}=V_{ref0}$.

The charges $Q_{cst}$ and $Q_{ref}$ on the first capacitor C1 and the second capacitor C2 are respectively as shown in formula (2-3) and formula (2-4).

$$Q_{cst}=(V_{data}-V_{ref})\times C_1 \quad (2\text{-}3)$$

$$Q_{ref}=(V_{ref}-V_{ref1})\times C_2 \quad (2\text{-}4)$$

$C_1$ is the capacitance value of the first capacitor C1, $C_2$ is the capacitance value of the second capacitor C2, the $Q_{cst}$ is the charge amount on the first capacitor C1, the $Q_{ref}$ is the charge amount on the second capacitor C2. Since the node Nref is not connected with other circuits except for the first capacitor and the second capacitor, on the first capacitor and the second capacitor connected with the node Nref, the charging charges on the first capacitor should be equal to the discharging charges on the second capacitor. The charges $Q_{ref0}$ on the second capacitor C2 in the first phase cannot be released, hence, the charge amount on the two capacitors meets the relationship of the following formula (2-5):

$$Q_{ref}-Q_{cst}=Q_{ref0} \quad (2\text{-}5)$$

Formula (2-6) can be obtained by bringing formulae (2-2), (2-3), (2-4) into formula (2-5);

$$(V_{ref}-V_{ref1})\times C_2-(V_{data}-V_{ref})\times C_1=(V_{ref0}-V_{ref1})\times C_2 \quad (2\text{-}6)$$

The following formula (2-7) is obtained by rearranging the formula (2-6);

$$V_{ref}=(V_{ref0}\times C_2+V_{data}\times C_1)/(C_2+C_1) \quad (2\text{-}7)$$

The following formula (2-8) is obtained by rearranging the formula (2-7);

$$V_{cst}=V_{data}-V_{ref}=(V_{data}-V_{ref0})\times[C_2/(C_2+C_1)] \quad (2\text{-}8)$$

$V_{cst}$ is the voltage across the first capacitor C1, $V_{cst}$ is a variable unrelated to $V_{ref1}$, i.e., a variable unrelated to the IR drop.

It shows that in phase 2, the data signal $V_{data}$ is transmitted on the data line. Here the control signal ($V_{gate1}$) outputted by the first timing control signal source enable the first switch transistor T1 to be turned off, the reference voltage signal $V_{ref0}$ on the second capacitor C2 is isolated from the data line, the reference voltage signal $V_{ref0}$ is maintained in the second capacitor C2, the second capacitor C2 is also called a hold capacitor. The control signal ($V_{gate2}$) outputted by the second timing control signal source enables the second switch transistor T2 and the third switch transistor T3 to be turned on, and enables the reference potential of the node Nref to be the reference potential of the second capacitor C2, and the signal voltage $V_{data}$ on the data line charges the first capacitor C1 so as to set up a signal voltage on the first capacitor C1.

The Third Phase: The Driving Phase (During Phase 3)

The first timing control signal source outputs a high level signal voltage $V_{gate1}$ to the first switch transistor T1 through the scanning signal line Scan1[$n$], the first switch transistor T1 is turned off under the effect of the high level signal voltage.

The second timing control signal source outputs a high level signal voltage $V_{gate2}$ to the second switch transistor T2 and the third switch transistor T3 through the scanning signal line Scan2[$n$], the second switch transistor T2 and the third switch transistor T3 are turned off under the effect of the high level signal voltage.

The luminescence control signal source outputs a low level signal voltage $V_{Emission}$ to the fourth switch transistor T4 and the fifth switch transistor T5 through the scanning signal line Em[n], the fourth switch transistor T4 and the fifth switch transistor T5 are turned on under the effect of the low level signal voltage.

The voltage $V_{cst}$ across the first capacitor C1 is the voltage $V_{gs}$ between the gate (g) and the source (s) of the driving transistor T0.

The fourth switch transistor T4 is turned on, the first capacitor C1 applies a voltage unrelated to the IR drop between the gate and the source of the driving transistor T0, $V_{gs}=V_{cst}=(V_{data}-V_{ref0})\times[C_2/(C_2+C_1)]$.

The fifth switch transistor T5 is turned on, the driving transistor T0 drives the light emitting device D1 to emit light, i.e., the fifth switch transistor T5 is turned on to control the current $I_{oled}$ for driving the OLED.

From the formula (2-1) it can be seen that $I_{oled}=K(V_{gs}-V_{th})^2=K\,[(V_{data}-V_{ref0})\times[C_2/(C_2+C_1)]-V_{th})]^2$.

It shows that in phase 3, the control signal ($V_{gate2}$) outputted by the second timing control signal source enables the second switch transistor T2 and the third switch transistor T3 to be turned off, the data line is isolated from the first capacitor C1, the signal voltage on the first capacitor C1 is maintained. Then, the control signal outputted by the luminescence control signal source enables the fourth switch transistor T4 and the fifth switch transistor T5 to be turned on, the signal voltage maintained on the first capacitor C1 is bridged between the source and the drain of the driving transistor T0, so as to drive the light emitting device to emit light.

According to the embodiment of the present invention, the first timing control signal source and the second timing control signal source control the turn-on time of the first switch transistor T1 and the second switch transistor T2 with the data line respectively. In the above first phase and second phase, the first switch transistor T1 and the second switch transistor T2 are not turned on simultaneously. In other words, the first timing control signal source and the second timing control signal source occupy the time of connecting with the data line within the row scanning period in a non-overlapping manner.

Thus, it can be seen that the current $I_{oled}$ that flows through the light emitting device D1 is only related to the reference voltage Vref0 provided in the first phase and the data signal voltage $V_{data}$ provided in the second phase by the first data signal source, and is related to the size of the capacitance of the first capacitor and the second capacitor, and unrelated to the DC voltages provided by the first reference signal source and the second reference signal source. Hence, it avoids pixel driving signal voltage deviation caused by layout IR drop of pixel array circuit, thereby improving uniformity of image luminance in the display area of the display device.

Next, another specific implementing mode of the pixel circuit as shown in FIG. 1 will be explained specifically.

Figure 5:
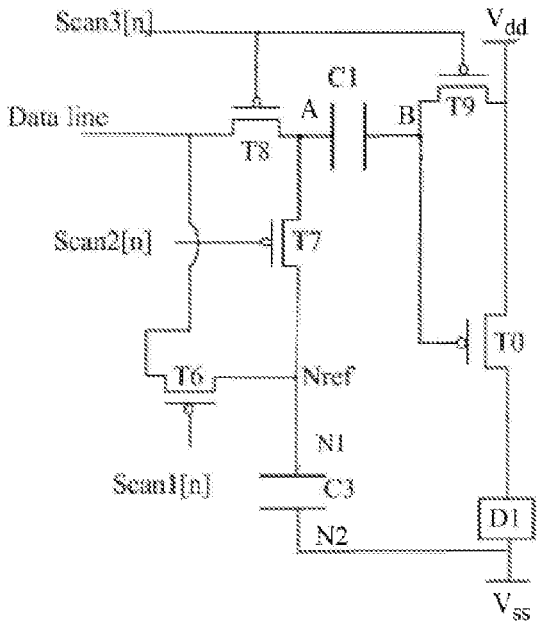
FIG. 5 is a further specific structural schematic view of the pixel circuit as shown in FIG. 1.

Referring to FIG. 5, it is another specific structural schematic view of the pixel circuit as shown in FIG. 1. In the pixel circuit as shown in FIG. 1, the reference voltage set up sub-circuit, besides comprising the first data signal source for providing the reference voltage $V_{ref0}$, further comprises: a third timing control signal source, a fourth timing control signal source, a third capacitor C3, a sixth switch transistor T6 and a seventh switch transistor T7.

The second end (end N2) of the third capacitor C3 is connected with the second reference signal source $V_{ss}$, the first end (end N1) of the third capacitor C3 is connected with the drain of the sixth switch transistor T6. The gate of the sixth switch transistor T6 is connected with the third timing control signal source through the first scanning signal line Scan1[$n$]. The source of the sixth switch transistor T6 is connected with the first data signal source through the data line.

The gate of the seventh switch transistor T7 is connected with the fourth timing control signal source through the second scanning signal line Scan2[$n$], the source of the seventh switch transistor T7 is connected with the first end (end N1) of the third capacitor C3, the drain of the seventh switch transistor T7 is connected with the first end (end A) of the first capacitor C1. The second end (end B) of the first capacitor C1 is connected with the first reference signal source $V_{dd}$.

The charging sub-circuit further comprises: a fifth timing control signal source, an eighth switch transistor T8 and a ninth switch transistor T9.

The gate of the eighth switch transistor T8 is connected with the fifth timing control signal source through the third scanning signal line Scan3[$n$]. The source of the eighth switch transistor T8 is connected with the first data signal source through the data line and the drain of the eighth switch transistor T8 is connected with the first end (end A) of the first capacitor C1.

The gate of the ninth switch transistor T9 is connected with the fifth timing control signal source through the third scanning signal line Scan3[$n$]. The source of the ninth switch transistor T9 is connected with the first reference signal source $V_{dd}$. The drain of the ninth switch transistor T9 is connected with the second end (end B) of the first capacitor C1.

Figure 6:
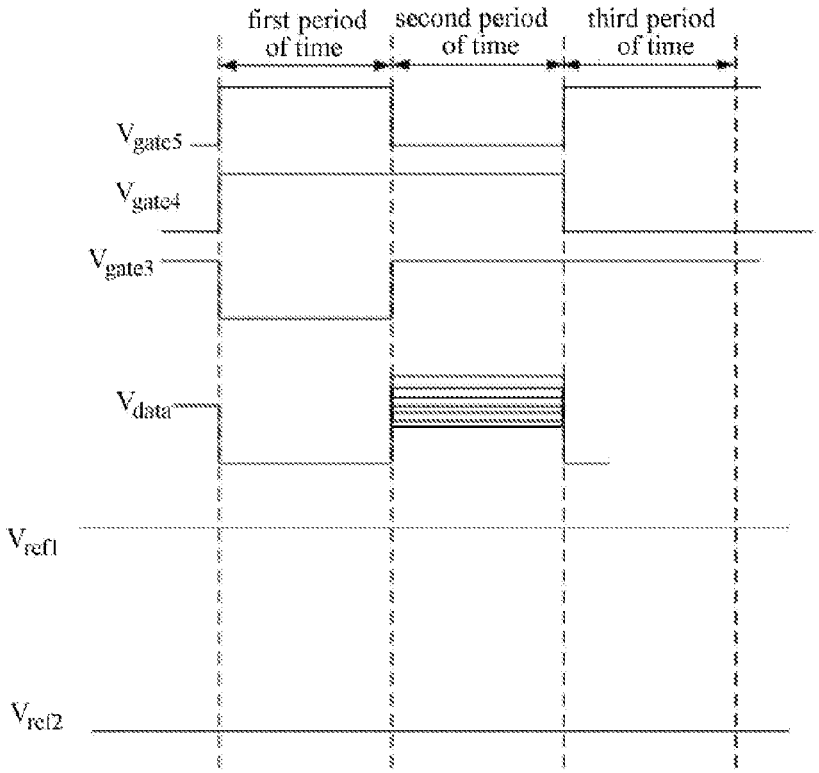
FIG. 6 is a timing diagram of working of the pixel circuit as shown in FIG. 5.

Next, the working principle of the pixel circuit provided by the above embodiment according to the present invention will be explained in combination with the timing diagrams as shown in FIG. 5 and FIG. 6.

The pixel circuit provided by the embodiment according to the present invention includes three working phases, which are successively: a reference voltage set up phase, a charging phase and a driving phase.

In the three phases of the reference voltage set up phase, the charging phase and the driving phase, the first reference signal source $V_{dd}$ outputs $V_{ref1}=V_{dd}$. The second reference signal source outputs $V_{ref2}=V_{ss}$, $V_{ref1}$ is less than $V_{ref2}$.

The First Phase (During Phase 1): The Reference Voltage Set Up Phase

The third timing control signal source outputs a low level signal voltage $V_{gate3}$ to the sixth switch transistor T6 through the first scanning signal line Scan1[$n$] and the sixth switch transistor T6 is turned on.

The fourth timing control signal source outputs a high level signal voltage $V_{gate4}$ to the seventh switch transistor T7 through the second scanning signal line Scan2[$n$]. The fifth timing control signal source outputs a high level signal voltage $V_{gate5}$ to the eighth switch transistor T8 and the ninth switch transistor T9 through the third scanning signal line Scan3[$n$]. The seventh switch transistor T7, the eighth switch transistor T8, and the ninth switch transistor T9 are turned off. The first data signal source outputs a reference voltage $V_{ref0}$ to the first capacitor C1 through the data line, and charges the first end (end N1) of the third capacitor C3 through the sixth switch transistor T6. After the charging is accomplished, the potential of the node Nref is $V_{ref0}$.

The charge amount on the third capacitor C3 is as shown in formula (3-1):

$$Q_{ref0}=C_3\times(V_{ref0}-V_{ref2}) \tag{3-1}$$

wherein $C_3$ is the capacitance value of the third capacitor.

The Second Phase (During Phase 2): The Charging Phase

The third timing control signal source outputs a high level voltage signal $V_{gate3}$ to the sixth switch transistor T6 through the first scanning signal line Scan1[*n*], the sixth switch transistor T6 is turned off. The fourth timing control signal source outputs a high level voltage signal $V_{gate4}$ to the seventh switch transistor T7 through the second scanning signal line Scan2[*n*]. The seventh switch transistor T7 is turned off. The fifth timing control signal source outputs a low level signal voltage $V_{gate5}$ to the eighth switch transistor T8 and the ninth switch transistor T9 through the third scanning signal line Scan3[*n*]. The eighth switch transistor T8 and the ninth switch transistor T9 are turned on. The first data signal source outputs a data signal voltage $V_{data}$ to the first capacitor C1 through the data line, so as to charge the first capacitor C1. Here, the first data signal source charges node A of the first capacitor C1, the first reference voltage $V_{ref1}=V_{dd}$ output by the first reference signal source charges node B of the first capacitor C1. The first data signal source charges node A of the first capacitor. Since the current through the data line is a pulse signal, the charging current is much less than the driving current of the light emitting device D1, the IR drop caused by resistance can be ignored. After the charging is accomplished, the potentials $V_A$ and $V_B$ on the nodes A and B, as well as the charge amount $Q_{cst0}$ on the first capacitor C1 are respectively as shown in formulae (3-2), (3-3) and (3-4).

$$V_A=V_{data} \tag{3-2}$$

$$V_B=V_{ref1} \tag{3-3}$$

$$Q_{cst0}=(V_{ref1}-V_{data})\times C_1 \tag{3-4}$$

When the charging phase is over, the voltages of the node B (i.e., the gate of the driving transistor T0) of the first capacitor C1 and the source of the driving transistor T0 are respectively $V_{ref1}$, the voltage difference between the gate and the source of the driving transistor T0 is zero.

The Third Phase: The Driving Phase (During Phase 3)

The third timing control signal source outputs a high level signal voltage $V_{gate3}$ to the sixth switch transistor T6 through the first scanning signal line Scan1[*n*], the fifth timing control signal source outputs a high level signal voltage $V_{gate5}$ to the eighth switch transistor T8 and the ninth switch transistor T9 through the third scanning signal line Scan3[*n*]. The sixth switch transistor T6, the eighth switch transistor T8 and the ninth switch transistor T9 are turned off.

The fourth timing control signal source outputs a low level signal voltage $V_{gate4}$ to the seventh switch transistor T7 through the second scanning signal line Scan2[*n*], the seventh switch transistor T7 is turned on. The potential of the node A is converted from $V_{data}$ to $V_{ref0}$. When parasitic effect is not considered, the voltage across the first capacitor C1 remains unchanged, then the potential of node B is converted as $V_{ref1}+(V_{ref0}-V_{data})$.

The voltage $V_{gs}$ between the gate and the source of the driving transistor T0 is as shown in formula (3-5):

$$V_{gs}=V_{ref1}+(V_{ref0}-V_{data})-V_{ref1}=V_{ref0}-V_{data} \tag{3-5}$$

Thus it can be seen that in the circuit as shown in FIG. 5, the voltage $V_{gs}$ between the gate and the source of the driving transistor T0 is a value unrelated to the first reference voltage $V_{ref1}=V_{dd}$ and the second reference voltage $V_{ref2}=V_{ss}$. Hence, it avoids pixel driving signal voltage deviation caused by layout IR drop of pixel array circuit, thereby improving uniformity of image luminance in the display area of the display device.

Next, the method of driving a pixel circuit provided by the embodiment according to the present invention will be explained briefly, comprising: controlling the reference voltage set up sub-circuit to provide a reference voltage for the driving sub-circuit (corresponding to the above first phase), and controlling the charging sub-circuit to provide a data signal voltage for the driving sub-circuit (corresponding to the above second phase).

The driving sub-circuit, under the effect of the reference voltage and the data signal voltage, driving the light emitting device to emit light (corresponding to the above third phase).

In an embodiment, through a data line connected with the reference voltage set up sub-circuit and the charging sub-circuit, the reference voltage is provided for the reference voltage set up sub-circuit within a first period of time. The data signal voltage is provided for the charging sub-circuit within a second period of time and the reference voltage is an AC signal voltage.

An embodiment according to the present invention further provides a display device, comprising a pixel circuit according to any of the above. The display device may be display devices such as an organic light emitting display panel, an organic light emitting display device, a flexible display screen and the like.

The driving transistor in the pixel circuit of each embodiment according to the present invention may be a thin film transistor (TFT), and may also be a metal oxide semiconductor (MOS) field effect transistor. The light emitting device of each embodiment according to the present invention may be an organic light emitting diode (OLED) or an organic electroluminescence element (EL). When the pixel circuit is in the luminescence phase, the light emitting device, under the effect of leakage current of the n-type driving transistor or the p-type driving transistor, realize luminescence display. The pixel circuit provided by each embodiment according to the present invention provides a reference voltage that maintains the data signal voltage for the OLED through the data line, which can ensure that the driving voltage for driving the OLED to emit light in the luminescence phase is unrelated to the layout IR drop of the pixel circuit, thereby improving uniformity of image luminance in the display area of the display device.

As is apparent, the skilled person in the art can make various modifications and variants to the respective embodiments according to the present invention without departing from the spirit and scope of the present invention. In this way, provided that these modifications and variants belong to the scopes of the claims of the present invention and the equivalent technologies thereof, the present invention would also intend to cover these modifications and variants.

The invention claimed is:

1. A pixel circuit for driving a light emitting device to emit light, comprising: a reference voltage set up sub-circuit, a charging sub-circuit and a driving sub-circuit;

the reference voltage set up sub-circuit and the charging sub-circuit being connected with the driving sub-circuit respectively, the reference voltage set up sub-circuit being used for, within a first period of time, setting up a reference voltage required by a drive data signal of the driving sub-circuit for driving the light emitting device to emit light, the charging sub-circuit being used for, within a second period of time, providing for the driving sub-circuit a data signal voltage required by the drive data signal for controlling the driving;

the driving sub-circuit comprising: a driving transistor for driving the light emitting device to emit light, and a first capacitor for maintaining the reference voltage and the data signal voltage; within a third period of time, the first capacitor discharging so that the driving transistor is turned on to drive the light emitting device to emit light, wherein the reference voltage set up sub-circuit comprises a first data signal source for providing the reference voltage, the first data signal source is a pulse signal source, and wherein the charging sub-circuit comprises a second data signal source for providing the data signal voltage, the first data signal source and the second data signal source are the same data signal source, the first data signal source outputs the reference voltage within the first period of time, and outputs the data signal voltage within the second period of time after the first period of time.

2. The pixel circuit according to claim 1, wherein the first data signal source transmits the reference voltage and the data signal voltage through a data line for transmitting the data signal voltage.

3. The pixel circuit according to claim 1, wherein a gate of the driving transistor is connected with a second end of the first capacitor, a source and a drain of the driving transistor are connected with a first reference signal source and an input end of the light emitting device respectively, an output end of the light emitting device is connected with a second reference signal source.

4. The pixel circuit according to claim 3, wherein the reference voltage set up sub-circuit further comprises: a first timing control signal source, a second timing control signal source, a second capacitor, a first switch transistor and a second switch transistor;

two ends of the second capacitor is connected with the first reference signal source and a drain of the first switch transistor respectively; the first timing control signal source is connected with a gate of the first switch transistor, the first data signal source is connected with a source of the first switch transistor; the second timing control signal source is connected with a gate of the second switch transistor, a source of the second switch transistor is connected with the drain of the first switch transistor, a drain of the second switch transistor is connected with a first end of the first capacitor.

5. The pixel circuit according to claim 4, wherein the charging sub-circuit further comprises: a third switch transistor;

a gate of the third switch transistor is connected with the second timing control signal source, a source of the third switch transistor is connected with the first data signal source, a drain of the third switch transistor is connected with a second end of the first capacitor.

6. The pixel circuit according to claim 5, further comprising: a luminescence control sub-circuit, the luminescence control sub-circuit comprising:

a luminescence control signal source, a fourth switch transistor and a fifth switch transistor, gates of the fourth switch transistor and the fifth switch transistor being connected with the luminescence control signal source respectively;

a source and a drain of the fourth switch transistor being connected with the first end of the first capacitor and the first reference signal source respectively;

a source and a drain of the fifth switch transistor being connected with the drain of the driving transistor and the input end of the light emitting device.

7. The pixel circuit according to claim 6, wherein the first switch transistor, the second switch transistor, the third switch transistor, the fourth switch transistor and the fifth switch transistor are n-type transistors or p-type transistors.

8. The pixel circuit according to claim 3, wherein the reference voltage set up sub-circuit further comprises: a third timing control signal source, a fourth timing control signal source, a third capacitor, a sixth switch transistor and a seventh switch transistor;

a second end of the third capacitor is connected with the second reference signal source, a first end of the third capacitor is connected with a drain of the sixth switch transistor; a gate of the sixth switch transistor is connected with the third timing control signal source, a source of the sixth switch transistor is connected with the first data signal source;

a gate of the seventh switch transistor is connected with the fourth timing control signal source, a source of the seventh switch transistor is connected with the first end of the third capacitor, a drain of the seventh switch transistor is connected with the first end of the first capacitor.

9. The pixel circuit according to claim 8, wherein the charging sub-circuit further comprises:

a fifth timing control signal source, an eighth switch transistor, a ninth switch transistor;

a gate of the eighth switch transistor is connected with the fifth timing control signal source, a source of the eighth switch transistor is connected with the first data signal source, a drain of the eighth switch transistor is connected with the first end of the first capacitor;

a gate of the ninth switch transistor is connected with the fifth timing control signal source, a source of the ninth switch transistor is connected with the first reference signal source, a drain of the ninth switch transistor is connected with the second end of the first capacitor.

10. The pixel circuit according to claim 9, wherein the sixth switch transistor, the seventh switch transistor, the eighth switch transistor and the ninth switch transistor are n-type transistor or p-type transistor.

11. A method for driving a pixel circuit, wherein the pixel circuit comprises: a reference voltage set up sub-circuit, a charging sub-circuit and a driving sub-circuit;

the reference voltage set up sub-circuit and the charging sub-circuit are connected with the driving sub-circuit respectively, the reference voltage set up sub-circuit is used for, within a first period of time, setting up a reference voltage required by a drive data signal of the driving sub-circuit for driving the light emitting device to emit light, the charging sub-circuit is used for, within a second period of time, providing for the driving sub-circuit a data signal voltage required by the drive data signal for controlling the driving;

the driving sub-circuit comprises: a driving transistor for driving the light emitting device to emit light, and a first capacitor for maintaining the reference voltage and the data signal voltage; within a third period of time, the first capacitor discharges so that the driving transistor is turned on to drive the light emitting device to emit light, wherein the reference voltage set up sub-circuit comprises a first data signal source for providing the reference voltage, the first data signal source is a pulse signal source, and wherein the charging sub-circuit comprises a second data signal source for providing the data signal voltage, the first data signal source and the second data signal source are the same data signal source, the first data signal source outputs the reference voltage within the first period of time, and outputs the data signal voltage within the second period of time after the first period of time, the method comprises the steps of:

controlling the reference voltage set up sub-circuit to provide the reference voltage to the driving sub-circuit, and controlling the charging sub-circuit to provide the data signal voltage to the driving sub-circuit;

the driving sub-circuit, under the effect of the reference voltage and the data signal voltage, driving the light emitting device to emit light.

12. The method according to claim 11, wherein, through a data line connected with the reference voltage set up sub-circuit and the charging sub-circuit, the reference voltage is provided to the reference voltage set up sub-circuit within the first period of time, the data signal voltage is provided to the charging sub-circuit within the second period of time, the reference voltage is an AC signal voltage.

13. A display device comprising a pixel circuit for driving a light emitting device to emit light, wherein the pixel circuit comprises: a reference voltage set up sub-circuit, a charging sub-circuit and a driving sub-circuit;

the reference voltage set up sub-circuit and the charging sub-circuit are connected with the driving sub-circuit respectively, the reference voltage set up sub-circuit is used for, within a first period of time, setting up a reference voltage required by a drive data signal of the driving sub-circuit for driving the light emitting device to emit light, the charging sub-circuit is used for, within a second period of time, providing for the driving sub-circuit a data signal voltage required by the drive data signal for controlling the driving;

the driving sub-circuit comprises: a driving transistor for driving the light emitting device to emit light, and a first capacitor for maintaining the reference voltage and the data signal voltage; within a third period of time, the first capacitor discharges so that the driving transistor is turned on to drive the light emitting device to emit light, wherein the reference voltage set up sub-circuit comprises a first data signal source for providing the reference voltage, the first data signal source is a pulse signal source, and wherein the charging sub-circuit comprises a second data signal source for providing the data signal voltage, the first data signal source and the second data signal source are the same data signal source, the first data signal source outputs the reference voltage within the first period of time, and outputs the data signal voltage within the second period of time after the first period of time.

14. The display device according to claim 13, wherein the first data signal source transmits the reference voltage and the data signal voltage through a data line for transmitting the data signal voltage.

15. The display device according to claim 13, wherein a gate of the driving transistor is connected with a second end of the first capacitor, a source and a drain of the driving transistor are connected with a first reference signal source and an input end of the light emitting device respectively, an output end of the light emitting device is connected with a second reference signal source.

* * * * *